US008783150B2

(12) United States Patent
Boss

(10) Patent No.: US 8,783,150 B2
(45) Date of Patent: Jul. 22, 2014

(54) DEVICE FOR TRIMMING A PRINT PRODUCT

(75) Inventor: Heinz Boss, Strengelbach (CH)

(73) Assignee: Muller Martini Holding AG, Hergiswil (CH)

( * ) Notice: Subject to any disclaimer, the term of this patent is extended or adjusted under 35 U.S.C. 154(b) by 1201 days.

(21) Appl. No.: 10/954,360

(22) Filed: Oct. 1, 2004

(65) Prior Publication Data

US 2005/0103178 A1 May 19, 2005

(30) Foreign Application Priority Data

Oct. 2, 2003 (EP) ..... 03405709

(51) Int. Cl.
*B26D 1/38* (2006.01)

(52) U.S. Cl.
USPC ..... 83/672; 83/698.51; 83/934

(58) Field of Classification Search
USPC ..... 83/342, 349, 672, 906, 698.31, 934
IPC ..... B26D 1/38,1/385
See application file for complete search history.

(56) References Cited

U.S. PATENT DOCUMENTS

| | | | | | |
|---|---|---|---|---|---|
| 1,648,422 | A | * | 11/1927 | Oppenheim et al. | 241/300.1 |
| 1,943,752 | A | * | 1/1934 | Wick | 83/158 |
| 2,100,930 | A | * | 11/1937 | Aiken | 83/342 |
| 2,870,840 | A | * | 1/1959 | Kwitek | 83/342 |
| RE26,418 | E | * | 7/1968 | Bradley | 83/342 |
| 3,822,625 | A | * | 7/1974 | Obenshain | 83/342 |
| 4,231,495 | A | * | 11/1980 | Lund | 222/345 |
| 4,478,030 | A | * | 10/1984 | Druais et al. | 56/60 |
| 5,001,953 | A | * | 3/1991 | Pfeiffer | 83/342 |
| 5,117,718 | A | * | 6/1992 | Wittkopf | 83/342 |
| 5,359,915 | A | * | 11/1994 | Hitz | 83/342 |
| 5,503,051 | A | | 4/1996 | Stauber | |
| 5,715,737 | A | * | 2/1998 | Stauber et al. | 83/154 |
| 5,809,856 | A | | 9/1998 | Reist et al. | |
| 5,832,799 | A | * | 11/1998 | Luthi et al. | 83/423 |
| 5,950,511 | A | | 9/1999 | Lüthi | |
| 5,996,457 | A | * | 12/1999 | Wingeron, Jr. | 83/349 |

FOREIGN PATENT DOCUMENTS

| | | | |
|---|---|---|---|
| CH | 687 371 | A5 | 11/1996 |
| DE | 1 074 392 | B | 1/1960 |
| EP | 0 367 715 | A1 | 5/1990 |
| EP | 0673729 | B1 | 3/1995 |

(Continued)

OTHER PUBLICATIONS

Japanese Office Action (w/German-to-English translation), issued on Jun. 11, 2010, in counterpart Japanese Application No. 2004-261294.

(Continued)

*Primary Examiner* — Kenneth E. Peterson
(74) *Attorney, Agent, or Firm* — Venable LLP; Robert Kinberg; Tamatane J. Aga

(57) ABSTRACT

A print product trimming device trims the forward edge of a print product supplied to it and has a stationary trimming knife having a knife shaft and a cutting edge attached to the knife shaft, a rotating drum, at least one counter knife attached to the rotating drum for rotating in a rotational direction and cooperating with the stationary knife along a circular cutting path. The trimming knife extends approximately transverse to the rotational direction of the counter knife. The cutting edge is a spiral cutting edge along surface lines of a cylindrical section that is formed by a cutting path of the counter knife. The knife shaft extends along the surface lines of the cylindrical section.

10 Claims, 5 Drawing Sheets

(56) References Cited

FOREIGN PATENT DOCUMENTS

| | | | |
|---|---|---|---|
| GB | 642140 | | 8/1950 |
| GB | 735381 | | 8/1955 |
| GB | 2 061 796 | A | 5/1981 |
| JP | 62042993 | U | 3/1987 |
| JP | 62117097 | U | 7/1987 |
| JP | 1060898 | U | 4/1989 |
| JP | 05-154796 | | 6/1993 |
| JP | 07-266644 | | 10/1995 |

OTHER PUBLICATIONS

Office Action (w/English translation) issued Feb. 24, 2011, in counterpart Norway Applciation No. 20044184.

* cited by examiner

DEVICE FOR TRIMMING A PRINT PRODUCT

CROSS-REFERENCE TO RELATED APPLICATION

This application claims the priority of European Patent Application No. 03405709.1, filed on Oct. 2, 2003, the disclosure of which is incorporated herein by reference.

BACKGROUND OF THE INVENTION

The invention relates to a device for trimming a print product that is supplied with one side edge to be trimmed facing forward to a trimming device, comprising a stationary trimming knife and at least one counter knife that cooperates with the stationary trimming knife along a circular cutting path, wherein the counter knife is mounted on a rotating drum.

Swiss Patent No. CH 687 371 A5 discloses a device of the above-described type where print products, supplied by a conveying arrangement having several rotating conveying units, pass through a trimming device that is arranged along the conveying arrangement. In the process, the print products are trimmed along one edge by stationary or rotating knives, wherein a device for supporting the print product overhang is provided on the opposite side and is rotatingly driven and synchronized with the conveying arrangement.

Cutting and trimming devices of this type must meet high demands with respect to cutting quality, cutting capacity and service life of the cutting tools. For that reason alone, it would be advantageous if the cutting tools could be used for cutting not over the complete cutting length, as is the case in prior art, but over part of the cutting length only.

SUMMARY OF THE INVENTION

It is therefore an object of the present invention to create a device where the cutting tool(s) is used over part of the cutting length only, which makes it possible to achieve a high cutting accuracy and cutting capacity, without having to increase the required energy and without reduction in the service life of the cutting tools.

The above and other objects are accomplished by the provision of a trimming device for trimming a print product which supplied to the trimming device with one side edge to be trimmed facing forward, the device comprising: a stationary trimming knife having a knife shaft and a cutting edge attached to the knife shaft; a rotating drum; and at least one counter knife attached to the rotating drum for rotating in a rotational direction and cooperating with the stationary knife along a circular cutting path; wherein the trimming knife extends approximately transverse to the rotational direction of the counter knife, the cutting edge is a spiral cutting edge along surface lines of a cylindrical section that is formed by a cutting path of the counter knife, and the knife shaft extends along the surface lines of the cylindrical section.

Thus, according to the invention, the trimming knife, which extends approximately transverse to the rotational direction of the counter knife, has a spiral cutting edge that extends along surface lines of a cylindrical section, formed by the cutting path of the counter knife, wherein this cutting edge is attached to a knife shaft extending along the surface lines of the cylindrical section. This permits a softer trimming with less noise of the print products than has been possible so far, and with less stress for the equipment parts used.

With respect to the circular cutting path, a respective cylindrical surface is retained at the trimming knife. The cylindrical surface extends behind the cutting edge of the trimming knife and ends at the trimming knife shaft.

For an easy regrinding of the trimming knife, it is advantageous if the knife shaft is attached so as to be detachable to a knife carrier.

A knife equipped with strip-type knife shaft is particularly suitable as trimming knife because it is easily removed.

The knife carrier is preferably designed as an ascending/descending clamping surface for attaching the trimming knife, which surface corresponds to the spiral cutting edge, so that a precise positioning of the trimming knife on the knife carrier is ensured.

It is useful if the clamping end of the knife carrier is a detachably mounted clamping strip, which has proven to be easy to handle during the assembly and dismantling of the trimming knife.

In a first embodiment, the trimming knife can be positioned with the back of the knife shaft against a reference end stop on the knife carrier, so that the trimming knife can be reattached in the original position following each removal from the knife carrier, e.g. for the regrinding.

The trimming knife of an alternative embodiment is arranged such that it can be displaced along the cutting path and can be adjusted once more to the original cutting position, e.g. following the grinding.

It has proven advantageous if the cutting edge of the first trimming knife can be reground on a flat side that is facing away from the cutting path, so that no special adjustment operations for the trimming knife are required later on, but only an adjustment of the knife carrier.

The knife carrier is readjusted with a pivoting movement, advantageously around the axis of rotation of the counter knife.

The trimming device is preferably provided with a rotating cutting drum on which at least one counter knife is installed.

Since the cutting edge of the counter knife can be a straight cutting edge that extends transverse to the rotational direction, the print products are not trimmed using the complete length of the knife edges, but using a type of scissor cut along the knife edges.

It is useful if the counter knives are designed such that they can be advanced in radial direction to the axis of rotation for the cutting drum and can be secured, such that the cutting gap can be re-adjusted even without regrinding of the trimming knife.

For a precise adjustment of the trimming knife, the trimming knife can be designed such that it can pivot around the axis of rotation of the cutting drum and can be secured.

BRIEF DESCRIPTION OF THE DRAWINGS

The invention is explained in the following with the aid of several exemplary embodiments and with reference to the drawing, to which we expressly refer for all details not mentioned in the description, wherein the drawing shows in.

DETAILED DESCRIPTION OF THE INVENTION

Figure 2:
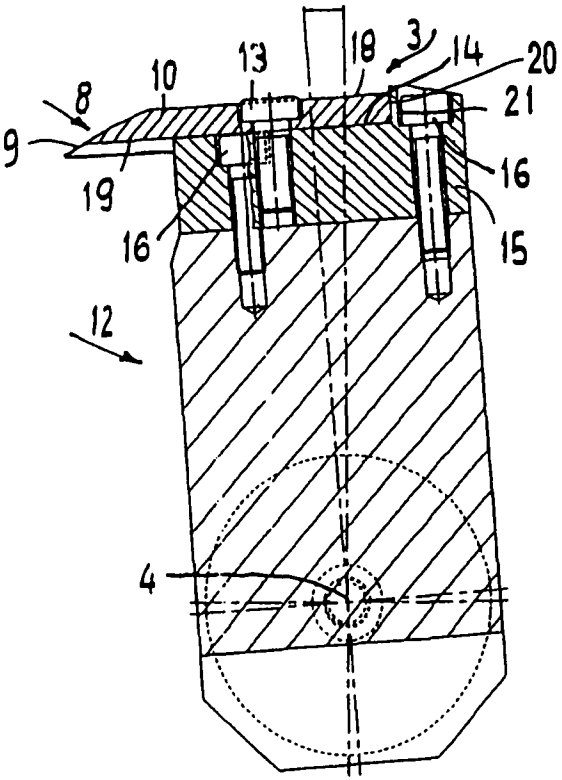
FIG. 2 shows a cross section through a knife carrier for which the cutting edge has been ground.
Figure 1:
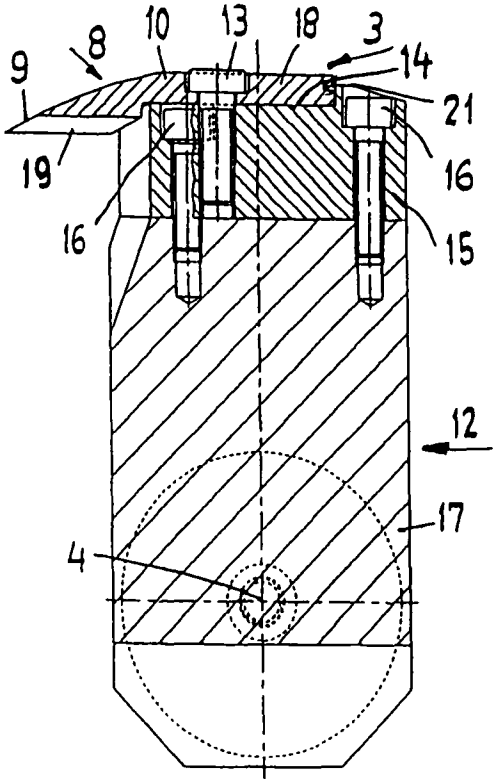
FIG. 1 shows a cross section through a knife carrier, as seen along the line I-I in FIG. 3.
Figure 3:
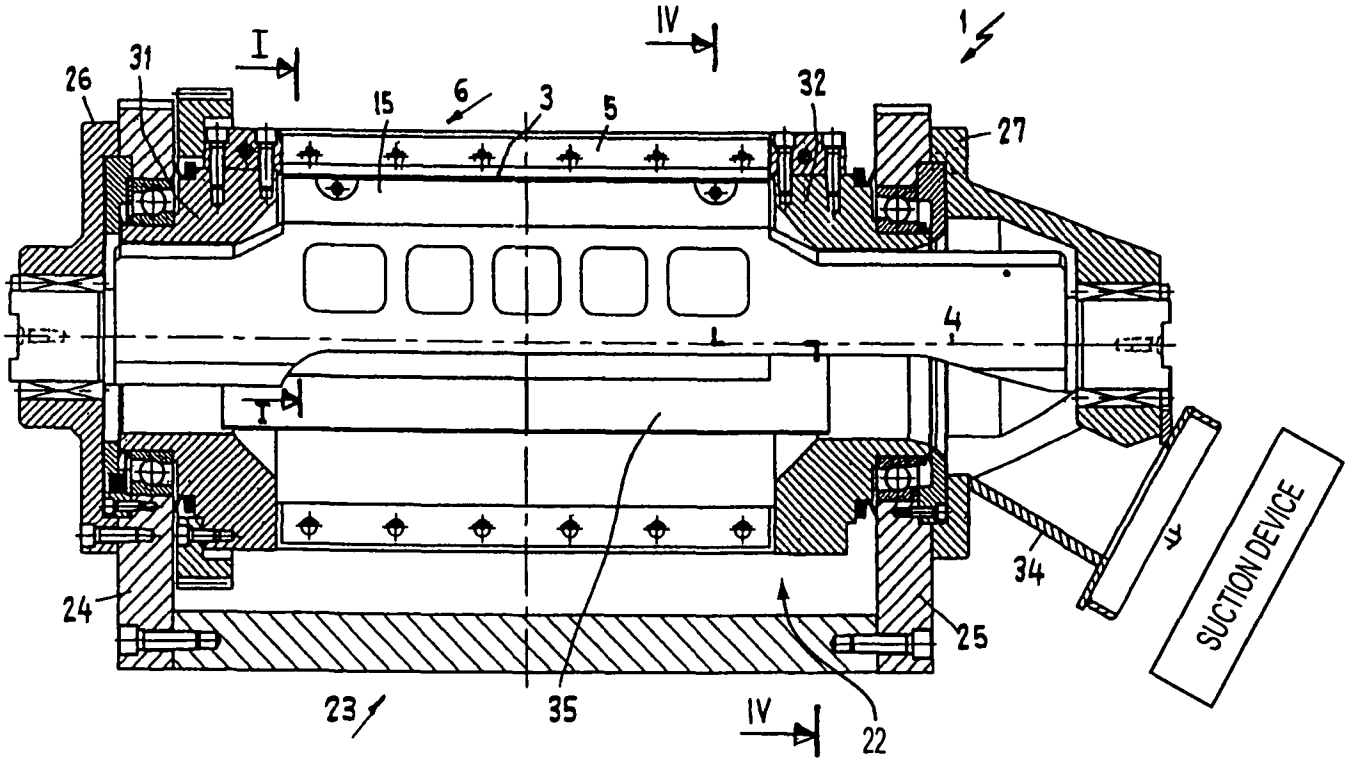
FIG. 3 shows a longitudinal section through a device for trimming print products, as seen along the line III-III in FIG. 4.
Figure 5:
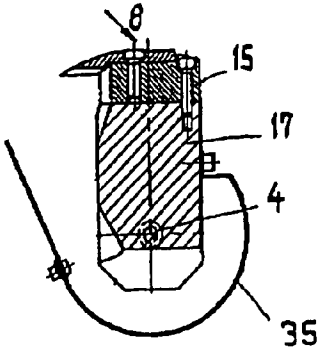
FIG. 5 shows a cross section through a knife carrier, as seen along line V-V in FIG. 8.
Figure 4:
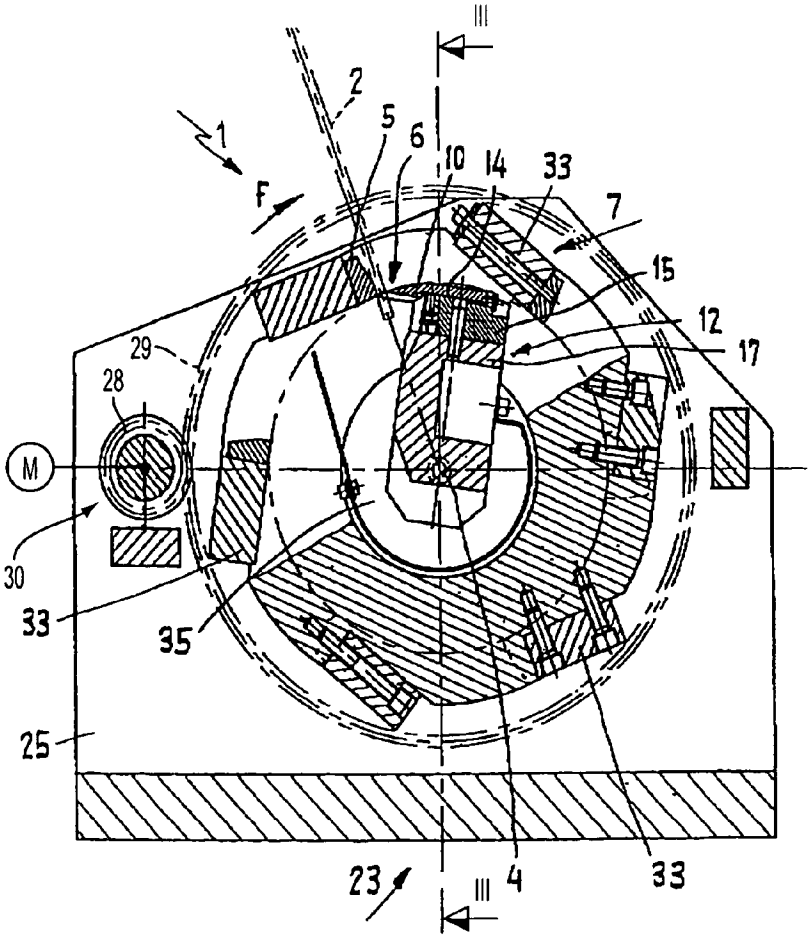
FIG. 4 shows a cross section through the device as seen along line IV-IV in FIG. 3.

FIGS. 1 and 2 both show a trimming knife 3 for trimming print products 2 which is installed in a device 1 (see FIG. 4). The trimming knife 3 is arranged non-rotatingly around an axis of rotation 4 for rotating counter knives 5 (FIGS. 3 and 4) and, together with the counter knives 5, forms a trimming device 6. The counter knives 5 are mounted on a rotating drum 7 and form a cutting drum.

Figure 6:
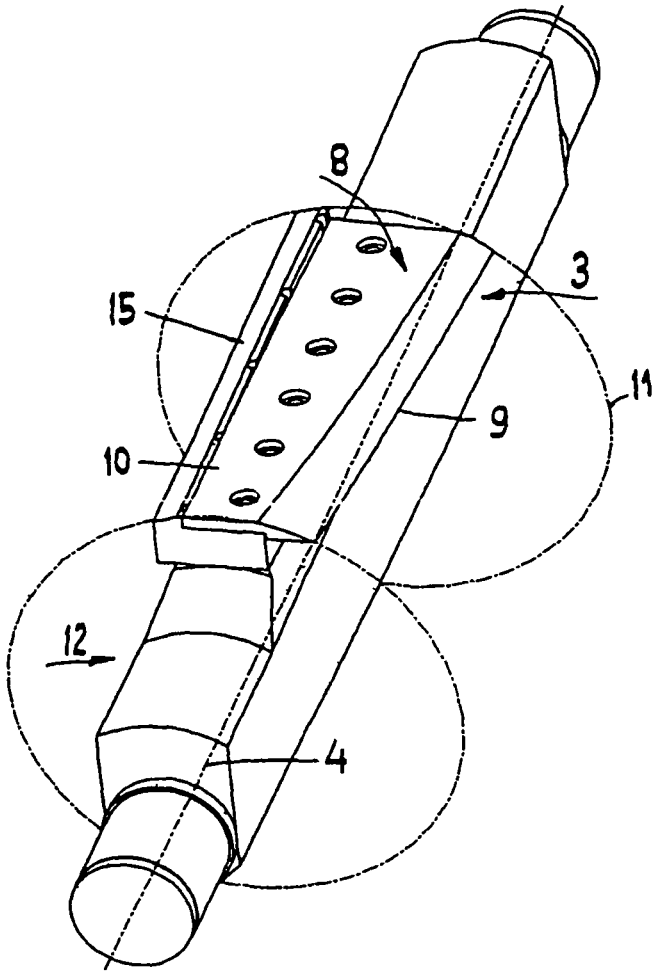
FIG. 6 shows a three-dimensional representation of the knife carrier, as shown in FIGS. 1, 2, 3 and 4.

The trimming knife 3, which is arranged and/or extends approximately transverse to the rotational direction F (FIG. 4) of the counter knife 5, has a spiral cutting edge 9 (see also FIG. 6) along surface lines of a cylindrical section 8, formed by a circular cutting path 11 of the counter knife 5, wherein the cutting edge is attached to a knife shaft 10 that extends along the surface lines of the cylindrical section. The three-dimensional representation of the knife carrier 12 in FIG. 6 clearly illustrates the spiral course of the knife edge 9 along the circular cutting path 11 of the rotating counter knives 5, which are arranged at a right angle to the rotational direction. The circular cutting path 11 consists of the wound section as the cylindrical region and extends behind the cutting edge 9 up to the knife shaft 10 of the trimming knife 3, which forms a slight offset with the wound section.

With the aid of screws 13 that extend through the strip-type knife shaft 10, the trimming knife 3 is detachably connected to a knife carrier 12, wherein the end for attaching it to the knife carrier 12 has an ascending and/or descending clamping surface 14 which corresponds to the spiral cutting edge. The clamping surface 14 is inclined approximately corresponding to the spiral slope and is arranged on a clamping strip 15 that forms the end of knife carrier 12, wherein the clamping strip is secured with clamping screws 16 to a support 17. The cutting edge 9 can be a hard metal blade or can be made from hardened steel. For the regrinding, the trimming knife 3 is detached from the clamping strip 15 and is clamped with the shaft back 18 onto a grinding machine table (not shown herein). Subsequently, the backside 19 of the trimming knife 3 is ground over for the regrinding of cutting edge 9. This operation can be repeated until the back 19 forms a single surface with the knife shaft 10. However, the knife edge 9 can also be reground with the aid of a grinding machine and while the knife carrier 12 is dismantled. The cutting edge 9 retreats as a result of the regrinding and the cutting position must be readjusted. For this, the knife carrier 12 is designed to pivot around the axis 4.

The trimming knife 3 in turn can be positioned with the back end 20 of knife shaft 10 against a reference end stop 21, arranged on the knife carrier 12, thus avoiding high requirements to be met for adjusting the cutting gap.

The reference end stop 21 for the present embodiment is located on the clamping strip 15 which forms the end of knife carrier 12. FIGS. 3 and 4 show the device 1 with a trimming knife 3, installed in a frame 23, as well as the rotating cutting drum 22. The cutting drum 22 is positioned precisely in side-mounted shields 24, 25 of frame 23, and the knife carrier 12 is positioned so as to be adjustable around the axis 4 (with clamping bushes) inside flanges 26, 27 that are attached to the side-mounted shields 24, 25. The cutting drum 22 is driven with the aid of a gear arrangement 30, consisting of two gearwheels 28, 29, which is connected to an electric motor M.

The cutting drum 22 has a cage-type design, meaning the drum ends 31, 32 are connected with the aid of several, six in this case, cross members 33 that are distributed along the periphery. The counter knives 5 are attached with screws to the cross members 33 of drum 7.

The cutting drum 22 is positioned with the drum ends 31, 32 in the side shields 24, 25 of frame 23, wherein the drum ends 31, 32 have a through bore that is concentric to the axis of rotation 4, wherein the ends of the knife carrier 12, positioned inside the flanges 26, 27, extend through these bores. According to FIG. 7, the counter knives 5 can be displaced in a radial direction to the circular cutting path 11 and/or can be adjusted to the desired cutting gap, e.g. 1/100 mm. Owing to the fact that the counter knives 5 pass by the cutting edge 9 of the trimming knife 3, it is possible to correct the concentricity error in the cutting position and to adjust the desired cutting gap for each trimming device 6, formed with the cutting edge 9 of trimming knife 3 and the counter knives 5. A readjustment bar 36 is provided for this, which extends across the length of one cross member 33 and is provided at the projecting edge with adjustment screws 37 and lock nuts 38 that act upon the counter knives 5.

Figure 7:
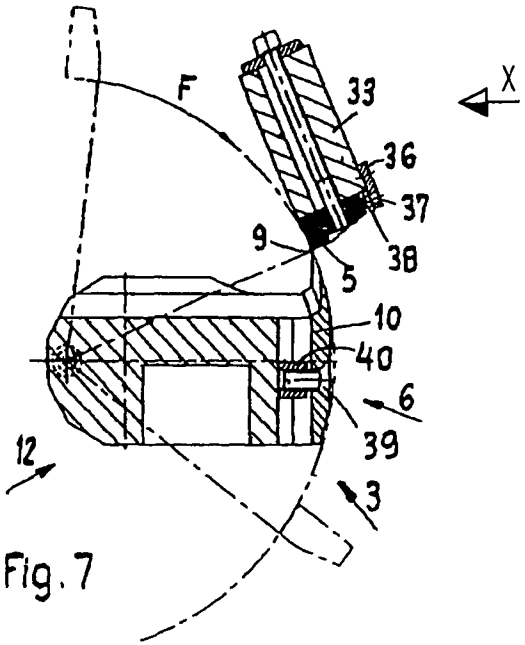
FIG. 7 shows a cross section through a trimming device, as seen along line VII-VII in FIG. 8
Figure 8:
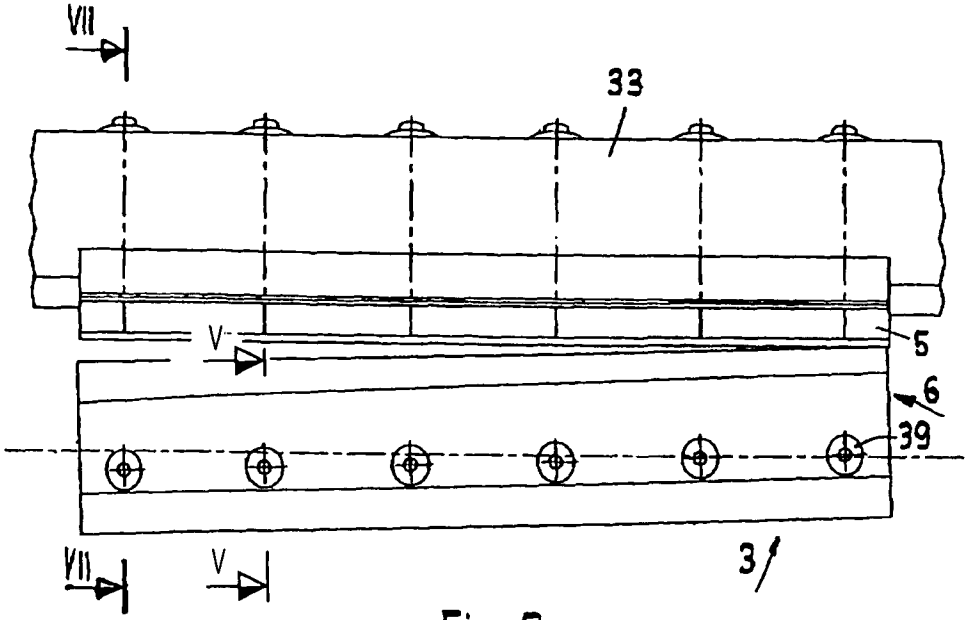
FIG. 8 shows a view from above of the trimming device, as seen along arrow X in FIG. 7.

FIGS. 7 and 8 show an arrangement, consisting of trimming knife 3 and counter knife 5 and/or a trimming device 6, for which the stationary trimming knife 3 is clamped on with a countersunk screw 39 and a crosshead 40, guided inside the knife carrier 12. The trimming knife 3 can be reground on the cylindrical surface while the adjustment of the cutting position is achieved by displacing the trimming knife 3 with the aid of the crosshead 40 and the countersunk screw 39. The through bore in one drum end 32 is connected on the one hand to the suction pipe 34 of a bearing flange 27 with hollow space 35 and, on the other hand, with a suction device (FIG. 3). A collection channel 35 is installed below the knife carrier 12, which empties into the through opening of the drum end 32 and removes with the aid of the suction device the cuttings generated during the trimming of the print products 2.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A trimming device for trimming a side edge of a print product supplied to the trimming device, said device comprising:

a knife carrier including an inclined clamping surface;

a trimming knife having a knife shaft and a cutting edge attached to the knife shaft, wherein the knife shaft is detachably mounted on the inclined clamping surface of the knife carrier, and wherein the trimming knife remains stationary during trimming of the side edge of the print product;

a rotating drum;

at least one counter knife attached to the rotating drum for rotating about an axis in a rotational direction and cooperating with the trimming knife along a circular cutting path;

wherein the trimming knife extends approximately transverse to the rotational direction of the counter knife, wherein the cutting edge is a spiral cutting edge along surface lines of a cylindrical section that is formed by the circular cutting path of the counter knife, wherein the knife shaft extends along the surface lines of the cylindrical section, wherein the trimming knife is positioned within the circular cutting path of the at least one counter knife attached to the rotating drum, wherein the inclined clamping surface ascends and/or descends relative to the axis and corresponding to the spiral cutting edge, and wherein the trimming knife is displaceable along the circular cutting path to adjust a cutting position when the trimming device is not operating.

2. The device according to claim 1, wherein the trimming knife is pivotable around the axis of rotation of the rotating drum to allow readjustment of a cutting position of the cutting edge and can be secured in place such that the trimming knife remains stationary during trimming of the one side edge of the print product.

3. The device according to claim 1, wherein the knife shaft has a strip design.

4. The device according to claim 1, wherein, when the trimming device is not operating, the at least one counter knife is radially adjustable relative to the axis of rotation, and can be secured in place.

5. The device according to claim 1, wherein the knife carrier has a clamping end formed by a detachably mounted clamping strip.

6. The device according to claim 1, wherein the knife carrier presents a reference stop, and a back end of the knife shaft is positioned against the reference end stop on the knife carrier.

7. The device according to claim 1, further comprising a collection channel positioned within the rotating drum to accept cuttings.

8. The device according to claim 7, further comprising a suction device connected to the collection channel.

9. The device according to claim 1, wherein the counter knife has a knife edge that extends parallel to the surface lines of the cylindrical section formed by the circular path of the counter knife or parallel to the axis of rotation of the rotating drum.

10. The device according to claim 1, wherein the knife carrier is pivotable around the axis of rotation to allow readjustment of a cutting position of the cutting edge and can be secured in place such that the trimming knife remains stationary during trimming of the one side edge of the print product.

* * * * *